US005463184A

United States Patent [19]

Kawamura

[11] Patent Number: 5,463,184

[45] Date of Patent: Oct. 31, 1995

[54] KEYBOARD INSTRUMENT HAVING A CATCHER STOPPER FOR SILENT OPERATION ON KEYBOARD

[75] Inventor: Kiyoshi Kawamura, Hamamatsu, Japan

[73] Assignee: Yamaha Corporation, Japan

[21] Appl. No.: 318,201

[22] Filed: Oct. 5, 1994

Related U.S. Application Data

[63] Continuation of Ser. No. 158,768, Nov. 30, 1993, abandoned.

[30] Foreign Application Priority Data

Jun. 3, 1993 [JP] Japan ..... 5-157934

[51] Int. Cl.[6] ..... G10C 3/12; G10C 5/00; G10D 15/00; G10H 1/34

[52] U.S. Cl. ..... 84/719; 84/720; 84/171; 84/423 R; 84/433; 84/236; 84/DIG. 7

[58] Field of Search ..... 84/600, 644, 670, 84/719, 720, 744, 745, 171, 236–255, 423 R, 433

[56] References Cited

U.S. PATENT DOCUMENTS

| | | | |
|---|---|---|---|
| 527,533 | 10/1894 | McChesney et al. . | |
| 533,661 | 2/1894 | McChesney et al. . | |
| 782,799 | 2/1905 | Smith . | |
| 2,250,065 | 7/1941 | Koel | 84/171 |
| 4,633,753 | 1/1987 | Takahashi | 84/220 |
| 4,704,931 | 11/1987 | Nagai | 84/1.01 |
| 4,744,281 | 5/1988 | Isozaki | 84/1.28 |
| 4,970,929 | 11/1990 | Ishida | 84/120 |
| 5,001,339 | 3/1991 | Starkley et al. | 250/229 |
| 5,115,705 | 5/1992 | Monte et al. | 84/617 |
| 5,247,129 | 9/1993 | Nozaki et al. | 84/615 |

FOREIGN PATENT DOCUMENTS

| | | |
|---|---|---|
| 0270966A2 | 6/1988 | European Pat. Off. . |
| 0573963A2 | 12/1993 | European Pat. Off. . |
| 97885 | 10/1897 | Germany . |
| 44782 | 9/1898 | Germany . |
| 3707591C1 | 5/1988 | Germany . |
| TO91U0077 | 10/1992 | Italy . |
| 51-67732 | 5/1976 | Japan . |
| 55-55880 | 4/1980 | Japan . |
| 62-32308 | 8/1987 | Japan . |
| 62-173792 | 11/1987 | Japan . |
| 63-97997 | 4/1988 | Japan . |

OTHER PUBLICATIONS

Japanese Utility Model Publication of Unexamined Application No. 62–173792 and a partial translation; Nov. 5, 1987.

*Primary Examiner*—Stanley J. Witkowski
*Attorney, Agent, or Firm*—Graham & James

[57] ABSTRACT

An acoustic piano, an electronic sound producing system and a controlling system form a keyboard instrument for selectively producing acoustic sounds and electronically synthesized sounds, and the controlling system has a catcher stopper for restricting rotations of catchers before hammer heads strike sets of strings in the electronic sound producing mode, thereby giving the unique piano key-touch to a player without mixing noise with the synthesized sounds.

10 Claims, 11 Drawing Sheets

KEYBOARD INSTRUMENT HAVING A CATCHER STOPPER FOR SILENT OPERATION ON KEYBOARD

This is a continuation of application Ser. No. 08/158,768 filed on Nov. 30, 1993 and now abandoned.

FIELD OF THE INVENTION

This invention relates to a keyboard instrument and, more particularly, to a keyboard instrument selectively entering into an acoustic sound mode and a silence mode.

DESCRIPTION OF THE RELATED ART

A piano gives a unique touch to a player, and an electronic keyboard synthesizer does not exactly imitates the unique key-touch, and an attempt was made on a compromise between a piano and an electronic synthesizer.

The compromise or the piano-like musical instrument has key action mechanisms coupled between the keyboard and the hammer assemblies and a tone generator system, and sounds are synthesized by the tone generator system. However, the key action mechanisms drives the hammer assemblies for striking the strings, and gives the unique key-touch to the player.

However, when a hammer strikes the strings, the strings vibrate, and produce an acoustic sound. The acoustic sound is mixed with the synthesized sound, and an audience feels the mixed sounds strange.

One of the piano-like keyboard instruments is disclosed in Japanese Publication of Examined Patent Application (Kokoku) No. 1-30155, and teaches how to decrease the loudness of the acoustic sounds. According to the Japanese Publication of Examined Application, a damper mechanism originally incorporated in the piano is brought into contact with the strings, and the damper mechanism restricts the vibrations on the struck strings.

Another muting mechanism incorporated in a grand piano is disclosed in Japanese Publication of Unexamined Utility Model Application (Kokai) No. 51-67732, and the muting mechanism restricts a hammer motion by means of a resilient member. According to the Japanese Publication of Unexamined Utility Model Application, the hammer concurrently strikes the resilient member and the associated strings, and the impact is split between the resilient member and the strings. As a result, the strings weakly vibrate, and the sound is lessened.

The prior art piano-like keyboard instruments can decrease the loudness of acoustic sounds. However, the prior art piano-like keyboard instruments can not perfectly eliminate the acoustic sounds from electrically synthesized sounds.

If the resilient member is moved to a closer position to the home position of the hammer, the hammer strikes the resilient member only, and the acoustic sound is not produced. However, the resilient member closer to the home position does not allow the jack to escape from the butt, and the key action mechanism can not give the unique key touch to the player.

If the hammer is removed, the strings never vibrate, and acoustic sounds are not mixed with the synthesized sounds. However, the keys are too light to give an appropriate resistance against the fingers of the player, and the key action mechanisms without hammers can not imitate the unique key-touch.

Thus, there is a trade-off between the acoustic sounds and the key-touch, and all of the prior art keyboard instruments do not satisfy players.

SUMMARY OF THE INVENTION

It is therefore an important object of the present invention to provide a keyboard instrument which gives the unique key-touch to a player without acoustic sounds.

To accomplish the object, the present invention proposes to interrupt the rotational of a catcher before an associated hammer strikes strings.

In accordance with the present invention, there is provided a keyboard instrument selectively entering a mechanical sound producing mode and an electronic sound producing mode, comprising: a) an acoustic piano including a-1) a keyboard having a plurality of keys turnable with respect to a stationary board member, the plurality of keys being selectively depressed in both mechanical and electronic sound producing modes by a player, a-2) a plurality of key action mechanisms respectively coupled with the plurality of keys, and selectively actuated by the plurality of keys when the player depresses, the plurality of key action mechanisms having respective whippens functionally connected with the plurality of keys, respectively, respective catchers respectively projecting from butts and respective back checks respectively projecting from the whippens so as to be brought into contact with the catchers when the player releases the associated keys, a-3) a plurality of hammer mechanisms respectively associated with the plurality of key action mechanisms, and having respective hammer heads and the butts supporting the hammer heads, respectively, the plurality of key action mechanisms being driven for rotation by the plurality of key action mechanisms when the player selectively depresses the plurality of keys, and a-4) a plurality of strings associated with the plurality of hammer mechanisms, and struck by the hammers in the mechanical sound producing mode when the player selectively depresses the plurality of keys; b) an electronic sound producing means monitoring the plurality of keys to see what keys are depressed by the player in the electronic sound producing mode, and operative to electronically produce sounds corresponding to the keys depressed by the player; and c) a controlling means having a plurality of movable stoppers associated with the catchers, and a driver unit responsive to an instruction of the player for driving the plurality of movable stoppers between a free position in the mecanically sound producing mode and a blocking position in the electronically sound producing mode, the catchers being freely moved together with the associated butts without interruptions of the plurality of movable stoppers while the movable stoppers are staying in the free position, the catchers being brought into contact with the movable stoppers in the blocking position before the associated hammer heads strike the plurality of strings.

BRIEF DESCRIPTION OF THE DRAWINGS

The features and advantages of the keyboard instrument according to the present invention will be more clearly understood from the following description taken in conjunction with the accompanying drawings in which.

DESCRIPTION OF THE PREFERRED EMBODIMENTS

First Embodiment

Figure 1:
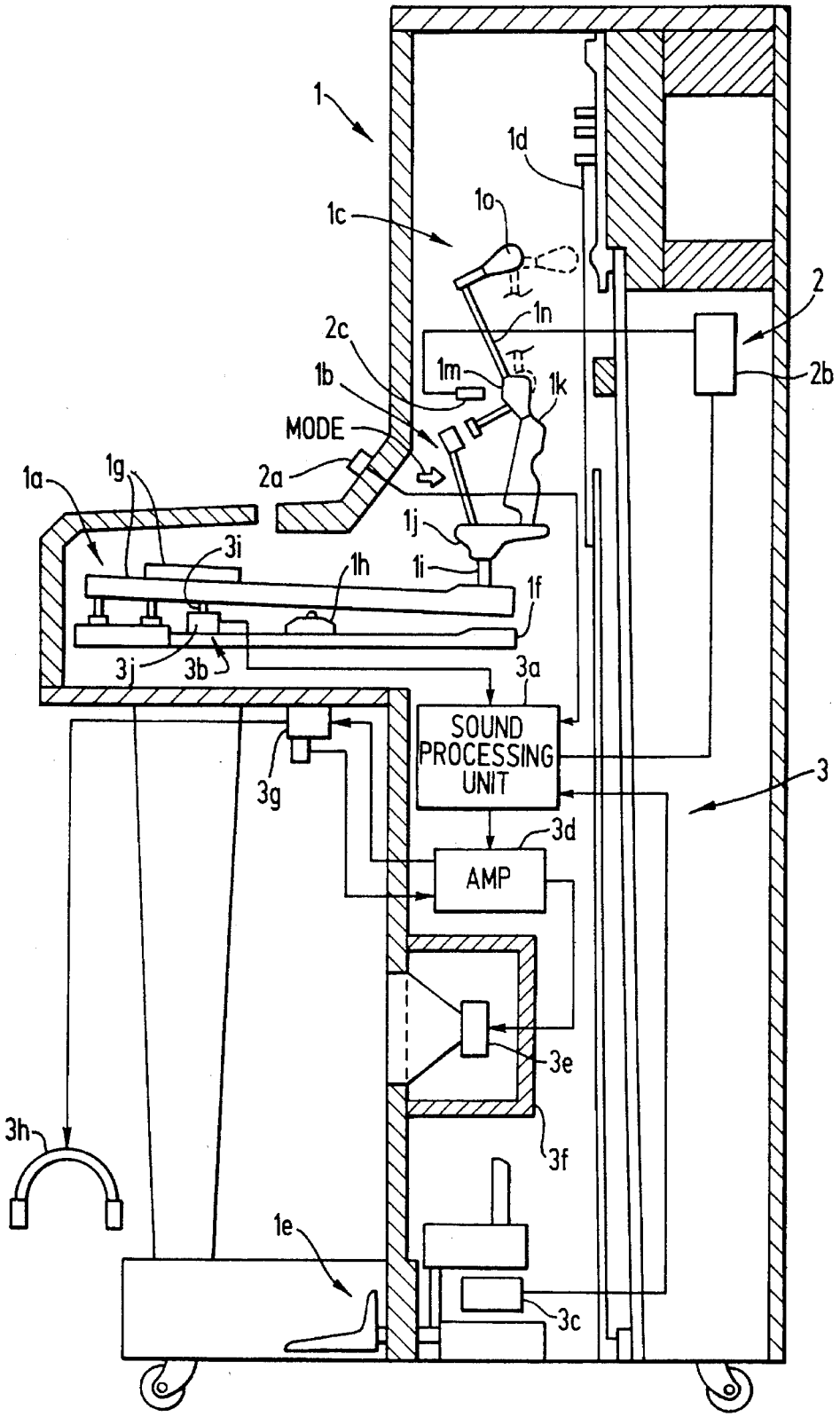
FIG. 1 is a cross sectional view showing the structure of a keyboard instrument according to the present invention.

Referring first to FIG. 1 of the drawings, a keyboard instrument embodying the present invention largely comprises an acoustic piano 1, a controlling system 2 and an electronic sound generating system 3, and selectively enters a mechanical sound producing mode and an electronic sound producing mode. In the following description, words "clockwise" and "counter-clockwise" are determined on a referenced figure.

While staying in the mechanical sound producing mode, the keyboard instrument serves as an acoustic upright piano, and not only the sounds but also the key-touch are identical with those of an acoustic upright piano.

On the other hand, the keyboard instrument electronically synthesizes sounds in response to keying-in in the electronic sound producing mode, and the acoustic sounds are not produced.

The acoustic piano 1 comprises a keyboard 1*a*, a plurality of key action mechanisms 1*b*, a plurality of hammer mechanisms 1*c*, a plurality sets of strings 1*d* and a pedal mechanism 1*e*. The keyboard 1*a* is mounted on a key bed 1*f*, and is fabricated from black and white keys 1*g*. In this instance, the key bed 1*f* serves as a stationary board member.

Each of the black and white keys 1*g* is associated with one of the key action mechanisms 1*b*, one of the hammer mechanisms 1*c* and a set of strings 1*d*, and a note is assigned to each of the keys 1*g*. Since all of the action lines from the keys 1*g* to the hammer mechanisms 1*c* are similar to one another, description is made on one of the action lines, and the key, the key action mechanism, the hammer mechanism and the set of strings of the action line are also labeled with 1*g*, 1*b*, 1*c* and 1*d*, respectively.

The key 1*g* is turnable with respect to a balance pin embedded in a balance rail 1*h*, and the associated key action mechanism 1*b* is respectively linked with the rear end of the key 1*g*. The key action mechanism 1*b* drives the associated hammer mechanism 1*c* for rotation when the associated key 1*g* is depressed.

Figure 2:
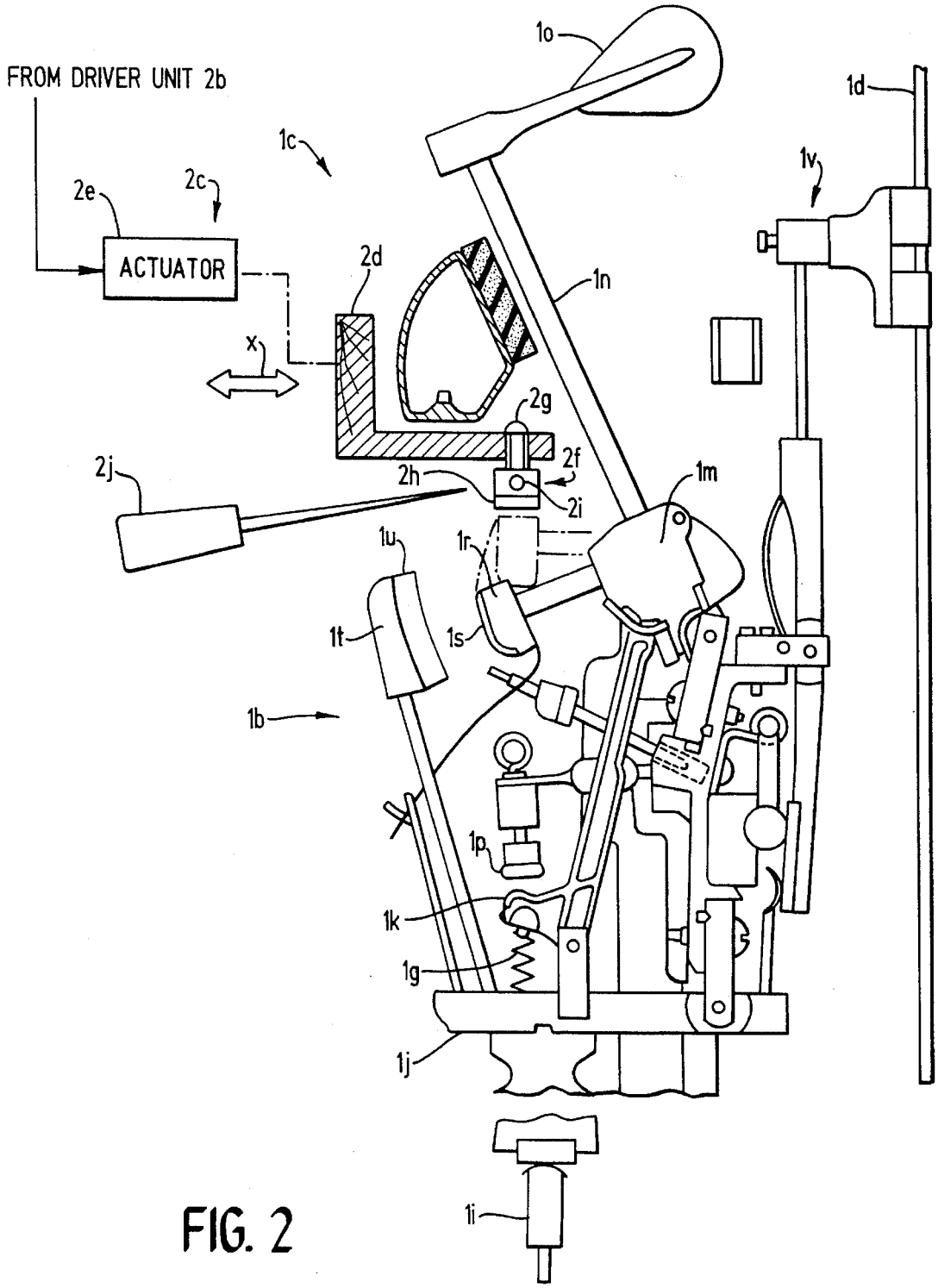
FIG. 2 is a side view showing, in an enlarged scale, a key action mechanism associated with a catcher stopper incorporated in the keyboard instrument.

As will be better seen from FIG. 2, the key action mechanism 1*b* comprises a capstan button 1*i* projecting from the rear end of the associated key 1*g*, an whippen 1*j* held in contact with the capstan button 1*i* and a jack 1*k* provided on the whippen 1*j*, and the jack 1*k* causes a the associated hammer mechanism 1*c* to strike the associated set of strings 1*d*.

The hammer mechanisms 1*c* comprises a butt 1*m* kicked by the jack 1*k*, a hammer shank In implanted in the butt 1*m* and a hammer head 1*o* coupled with the leading end of the hammer shank 1*n*. While a player is depressing the key 1*g* from the rest position to a first intermediate position, the jack 1*k* slowly drives the butt 1*m* for rotation in the clockwise direction, and the hammer head 1*o* is also slowly moved toward the set of strings 1*d*. When the key 1*g* reaches the intermediate position, the jack 1*k* is brought into contact with a regulating button 1*p*, and the rotation of the whippen 1*j* is converted to the elastic force of a spring 1*q*. When the key proceeds to a second intermediate position, the jack 1*k* kicks the butt 1*m*, the butt 1*m* and, accordingly, the hammer head 1*o* are driven for rotation at high speed toward the set of strings 1*d*, and the hammer head 1*o* strikes the set of strings 1*d* so that the strings 1*d* vibrate for producing an acoustic sound. Upon the strike at the set of strings 1*d*, the hammer head 1*o* rebound on the set of strings 1*d*, and the butt 1*m* and the hammer heads 1*o* rotate in the counter clockwise direction so as to return to the home position.

The key action mechanism 1*b* further comprises a catcher 1*r* backwardly projecting from the butt 1*m*, a catcher skin 1*s* attached to the catcher 1*r*, a back check block 1*t* upwardly projecting from the whippen 1*j* and a back check felt 1*u* attached to the back check block 1*r*. While the butt 1*m* is rotating in the clockwise direction, the catcher 1*r* also rotates in the clockwise direction. After the rebound on the set of strings 1*d*, the catcher 1*r* returns to the home position together with the butt 1*m*. The key 1*g* released from the end position causes the whippen 1*j* and, accordingly, the back check block 1*t* to rotate in the clockwise direction, and the back check felt 1*u* softly decelerates the catcher 1*r*.

Thus, the key action mechanisms 1*b*, the hammer mechanisms 1*c*, the pedal mechanism 1*e* and the damper mechanisms 1*v* are similar to those of an upright piano, and the upright piano is available for the acoustic piano 1.

Turning back to FIG. 1, the pedal mechanism 1*e* usually have three pedals and three pedal link submechanisms respectively connected with the pedals. One of the pedal is called as a damper pedal, and allows the strings 1*d* to prolong the sound. The second pedal is called as a soft pedal, and causes the hammer heads 1*o* to strike fewer than the normal number of strings for lessening the volume. The last pedal is called as a sostenuto pedal, and enables selected notes to be sustained independently from the others.

The keyboard instrument further comprises a damper mechanisms 1*v*. However, the damper mechanisms and the pedal mechanism 1*e* are well known to a person skilled in the art, and no further description is incorporated hereinbelow.

The controlling system 2 comprises a sound processing unit 3*a*, a mode shift switch 2*a*, a driver unit 2*b* and a catcher stopper mechanism 2*c*. The mode shift switch 2*a* is manipulated by a player, and produces an instruction signal MODE indicative of one of the mechanical sound producing mode and the electronic sound producing mode.

As shown in FIG. 2 in detail, the catcher stopper mechanism 2*c* comprises a movable bracket member 2*d* of wood shared between all of the key action mechanisms 1*b*, a solenoid-operated actuator unit 2*e* responsive to a driving signal indicative of the electronic sound producing mode for projecting and retracting the movable bracket member 2d in directions indicated by arrow X and a plurality of stoppers 2f respectively associated with the catchers 1r of the plurality of key action mechanisms 1b.

When the solenoid-operated actuator unit 2e leftwardly moves the movable bracket member 2d, the stoppers 2f enter into a free position, and the catchers 1r can rotate together with the butts 1m without interruption of the stoppers 2f.

On the other hand, when the solenoid-operated actuator unit 2e rightwardly moves the movable bracket member 2d, the stoppers 2f enter into a blocking position, and the catchers 1r are brought into contact with the stoppers 2f before the hammer heads 1o strike the associated sets of strings 1d.

Each of the stoppers 2f is analogous to a capstan screw of a grand piano, and has a bolt member 2g screwed in the movable bracket member 2d at respective positions over the associated catchers 1r and a leather pad 2h attached to the lower surface of the bolt member 2g. The leather pads 2h are confronted to the upper surfaces of the catchers 1r, and the upper surfaces of the catchers 1r are brought into contact with the leather pads 2h of the stoppers 2f in the blocking position. The leather pads 2h are replaceable with felt pads or cloths.

Through-holes 2i are respectively formed in the bolt members 2g, and a regulating tool 2j is insertable into the through-holes 2i. Namely, while the keyboard instrument is standing idle, a tuner regulates the projection of each stopper 2f by turning the stoppers 2f with the tool 2j. In this instance, distances between the stoppers 2h and the catchers 1r are regulated in such a manner that the catchers 1r are brought into contact with the stoppers 2f at appropriate timings between escapes of the associated jacks 1k and strikes at the strings 1d. The distances between the toes of the jacks 1k and the regulating buttons 1p are regulated to about 3 millimeters for low-pitched tones, 2.5 millimeters for middle-pitched tones and 2 millimeters for high-pitched tones, and the distances between the catchers 1r and the leather pads 2h are not less than these regulated values. This regulation of the stoppers 2f allows the butts 1m to escape from the associated jacks 1k, but does not allow the hammer heads 1o to strike the associated sets of strings 1d. In other words, the key action mechanisms 1b give the unique key touch to the player without acoustic sounds.

Turning back to FIG. 1, the electronic sound producing system 3 comprises a sound processing unit 3a, an array of key sensors 3b for monitoring key actions, an array of pedal sensors 3c for monitoring pedal actions, an amplifier system 3d, a speaker system 3e housed in a speaker box 3f, a socket unit 3g and a head phone 3h detachable from the socket unit 3g.

The sound processing unit 3a periodically checks an input port assigned to the instruction signal MODE to see whether or not the player changes the operation mode. While staying in the mechanical sound producing mode, the sound processing unit 3a instructs the driver unit 2b to keep the stoppers 2f in the free position. On the other hand, if the instruction signal MODE is indicative of the electronic sound producing mode, the sound processing unit 3a instructs the driver unit 2b to change the stopper 2c from the free position to the blocking position BP.

The plurality of key sensors 3b are respectively associated with the plurality of keys 1g, and each of the key sensors 3b comprises a shutter plate 3i fixed to the bottom surface of the associated key and a photo-interrupter 3j monitoring the shutter plate 3i. Four different patterns are formed in the shutter plate 3i, and the four patterns sequentially passes through an optical path produced by the photo interrupter 3j when the associated key is depressed. Time intervals between the four patterns are reported from the photo interrupter 3j to the sound processing unit 3a, and the sound processing unit 3a determines the key velocity and estimates the time when the associated hammer head lo strikes the strings 1d.

The pedal sensors 3c monitor the three pedals to see whether or not the player steps on any one of the three pedals. If the player steps on one of the pedals, the pedal sensors 3c detect the motion of the pedal, and report the pedal manipulated by the player to the sound processing unit 3a.

Figure 3:
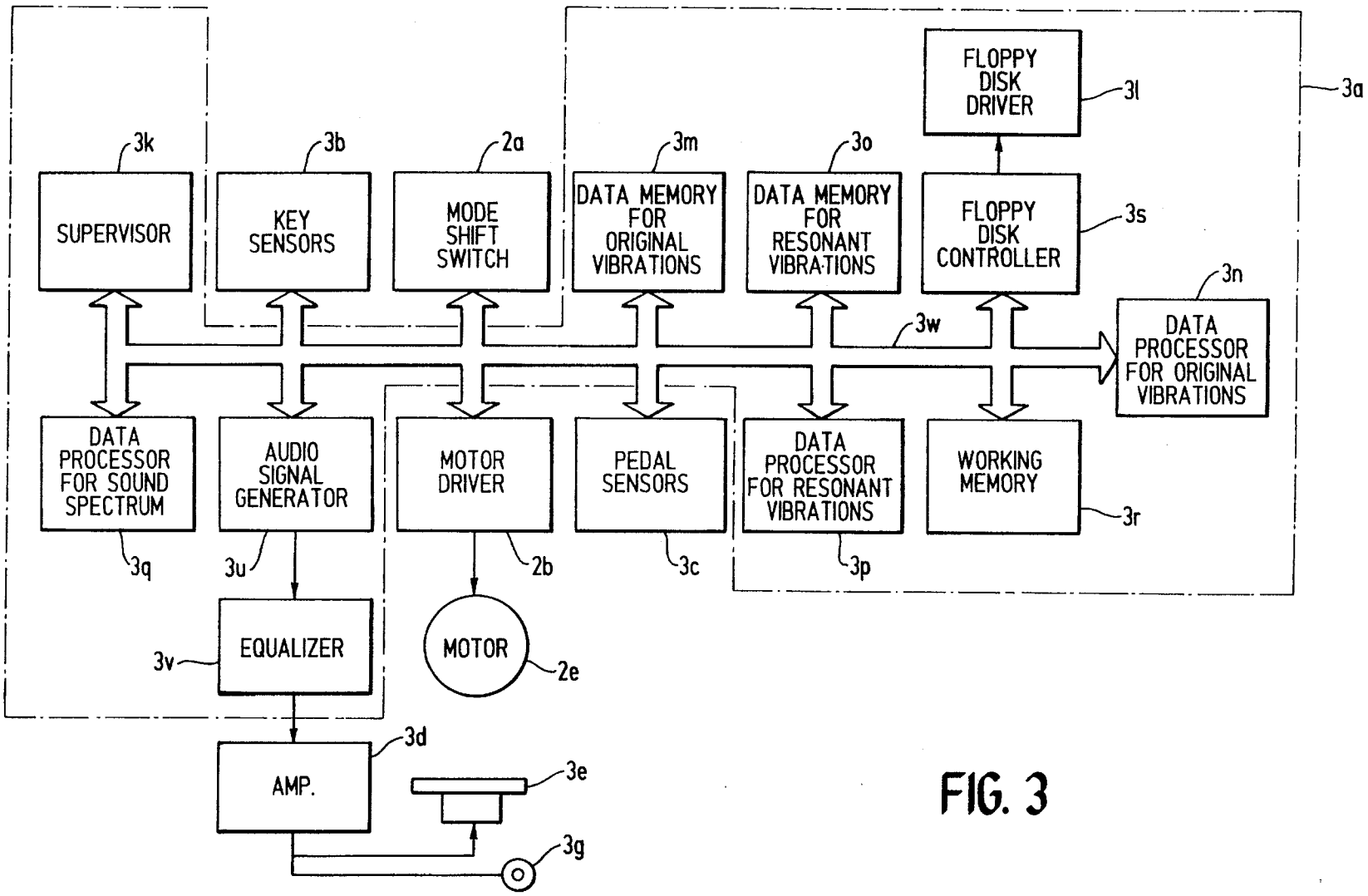
FIG. 3 is a block diagram showing the arrangement of the sound producing unit.

Turning to FIG. 3 of the drawings, the sound processing unit 3a comprises a supervisor 3k, a data memory 3m for original vibrations, a data processor 3n for original vibrations, a data memory 3o for resonant vibrations, a data processor 3p for resonant vibrations, a data processor 3q for sound spectrum, a working memory 3r, a floppy disk controller 3s, a floppy disk driver 3t, an audio signal generator 3u, an equalizer 3v and a bus system 3w.

The supervisor 3k sequentially scans signal input ports assigned to the instruction signal MODE, the detecting signals from the key sensors 2b and the detecting signals from the pedal sensors 2c, and supervises the other components 3m to 3u for producing an audio signal.

An internal table is incorporated in the supervisor 3k, and the internal table defines relation between the key numbers, key velocity and timings for producing the audio signal. The audio signal is supplied from the equalizer 3v to the amplifier unit 3d, and the audio signal is distributed to the speaker system 3e and the socket unit 3g for producing synthesized sounds.

Various internal registers are incorporated in the supervisor 3k, and one of the internal registers is assigned to a mode flag indicative of the operation mode selected by the player.

The data memory 3m for original vibrations stores a plurality sets of pcm (Pulse Code Modulation) data codes indicative of frequency specular of original vibrations on the strings 1d, and each set of pcm data codes is corresponding to one of the keys 1g. A plurality groups of pcm data codes form a set of pcm data codes, and are corresponding to frequency specular at different intensities or hammer speeds. In general, if a hammer 1o strongly strikes the associated string 1d, higher harmonics are emphasized. The plurality sets of pcm data codes are produced with a sampler (not shown) through sampling actual vibrations on the respective strings 1d at an appropriate frequency. However, the set of pcm data codes may be produced by means of the data processor 3q through a realtime manner. Using a group of pcm data codes, original vibrations produced upon depressing a key 1g are restored, and the supervisor 3k controls the sequential access to a group of pcm data codes stored in the data memory 3m.

The data processor 3n for original vibrations is provided in association with the data memory 3m, and modifies a group of pcm data codes for an intermediate hammer speed. The modification with the data processor 3n is also controlled by the supervisor 3k.

The data memory 3o for resonant vibrations stores a plurality sets of pcm data codes indicative of resonant vibrations, and the resonant vibrations take place under a step on the damper pedal. While a player steps on a damper pedal of a piano, dampers are held off, and some of the strings 1*d* are resonant with the string struck by an associated hammer. The resonant tones range −10 dB and −20 dB with respect to the tone originally produced through striking with a hammer 1*o*, and time delay of several millisecond to hundreds millisecond is introduced between the originally produced sound and the resonant tones. If the player continuously steps on the damper pedal, the resonant tones continues several seconds. However, the player can rapidly terminate the original and resonant tones by releasing the damper pedal, and the audio signal generator 3*u* is responsive to the detecting signal of the pedal sensors 2*c* for the rapid termination.

The pcm data codes stored in the data memory 3*o* are indicative of frequency specular of the resonant vibrations, and are also produced by means of the sampler or the data processor for resonant vibrations 3*p*. Each of the plurality sets of pcm data codes is corresponding to one of the depressed keys 1*g*, and is constituted by six groups of pcm data codes at the maximum. Each group of pcm data codes is corresponding to one of the resonant strings 1*d*, and the second harmonic to the sixth harmonic are taken into account for strings one octave higher than low-pitched sounds. However, if the depressed key is lower than the thirteenth key from the lowest key in the eighty-eight keys, the string one octave lower than the depressed key should be taken into account.

In general, seventy-one dampers are incorporated in a piano. Another piano may have sixty-six dampers or sixty-nine dampers. As described hereinbefore, the intensity of frequency spectrum is corresponding to the hammer speed. However, the intensities are variable with the type and model of the piano.

A set of pcm data codes are sequentially read out from the data memory 3*o* depending upon the depressed key 1*g* under the control of the supervisor 3*k*, and the data processor for resonant vibrations 3*p* modifies the pcm data codes for an intermediate intensity. The memory capacity of the data memory 3*o* may be large enough to store the pcm data codes at all of the detectable hammer speeds, and the data processor 3*p* may calculate each set of pcm data codes on the basis of parameters stored in the data memory 3*o*.

The data processor 3*q* for sound spectrum can produce a group of pcm data codes indicative of frequency spectrum for original vibrations and a set of pcm data codes indicative of frequency specular for resonant vibrations as described hereinbefore. The data processor 3*q* is further operative to cause the frequency specular to decay.

In detail, when a player releases a key of a piano, original vibrations on a string rapidly decays, because an associated damper 1*v* is brought into contact with the strings 1*d*. The data processor 3*q* simulates the decay, and sequentially decreases the values of the pcm data codes. The resonant tones continue for several seconds in so far as the player keeps the damper pedal in the depressed state. However, if the player releases the damper pedal, the resonant tones are rapidly decayed. The data processor 3*q* further simulates the decay, and sequentially decreases the values of the pcm data codes for the resonant vibrations.

The decay is not constant. If the player releases the damper pedal through a half pedal, the tones decay at lower speed rather than the ordinary release. Moreover, some players use the half pedal in such a manner as to retard low-pitched tones rapidly rather than high-pitched tones, and such a pedal manipulation is called as an oblique contact. On the contrary, if the damper pedal causes all the dampers to be simultaneously brought into contact with the strings, the damper manipulation is called as a simultaneous contact. The data processor 3*q* can simulate the gentle decay upon the release through the half pedal as well as the oblique contact, and the values of the pcm data codes are decreased at either high, standard or low speed in the simultaneous contact and at different speed in the oblique contact. The data processor 3*q* may change the ratio between the fundamental tone and the harmonics thereof for the half pedal and decay high-order harmonics faster than the fundamental tone. The frame of a piano usually vibrates, and the frame noises participate the piano tone. The data processor 3*q* may take these secondary noises into account and modify the frequency ratio.

The audio signal generator 3*u* comprises a digital filter, a digital-to-analog converter and a low-pass filter, and produces an analog audio signal from the pcm data codes supplied from the data memories 3*m* and 3*o* and/or the data processors 3*n*, 3*p* and 3*q*. The pcm data codes are subjected to a digital filtering, and are, then, converted into the analog audio signal. In the digital filtering, the vibration characteristics of the speaker system 3*e* and vibratory characteristics of the speaker box 3*f* are taken into account, and the pcm data codes are modified in such a manner that the frequency spectrum of produced sounds becomes flat. The digital filter is of the FIR type. However, an IIR type digital filter is available. An oversampling type digital filter may follow the digital filtering for eliminating quantized noises.

After the digital filtering, the digital-to-analog converter produces the analog audio signal, and the analog audio signal is filtered by the low-pass filter, and the low-pass filter is of a Butterworth type for improving group delay. The analog audio signal thus filtered is supplied through the equalizer 3*v* to the amplifier unit 3*d*, and the amplifier unit 3*d* amplifies the analog audio signal for driving the speaker system 3*e*.

The floppy disk driver 3*t* reads out data codes formatted in accordance with the MIDI standards from a floppy disk under the control of the floppy disk controller 3*s*, and the supervisor 3*k* allows the audio signal generator 3*u* to reproduce sounds from the data codes read out from the floppy disk. Therefore, a music can be reproduced in the timbre of another musical instrument such as, for example, a pipeorgan, a harpsichord or a wind musical instrument.

The supervisor 3*k* may format the detecting signals of the key sensors 2*b* and the detecting signals of the pedal sensors 2*c* in accordance with the MIDI standards, and the MIDI codes are stored in a floppy disk under the control of the floppy disk controller 3*s*. If the keyboard instrument can record a performance, the keyboard instrument has three modes of operation, i.e., the mechanically and electronically sound producing modes and the recording mode.

Figure 4A:
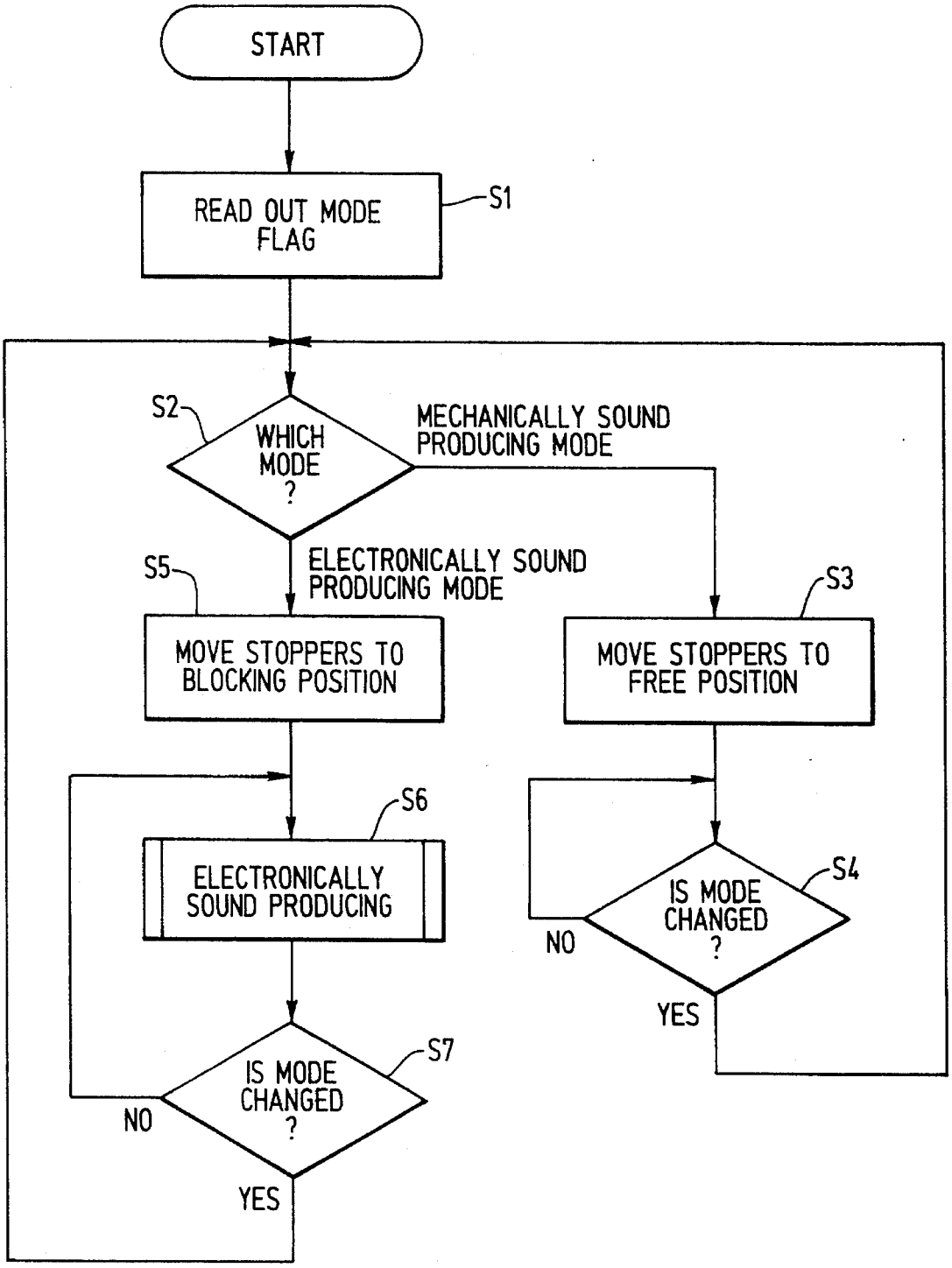
FIGS. 4A and 4B are flowcharts showing a program sequence executed by the sound producing unit.

The keyboard instrument thus arranged executes a program sequence illustrated in FIG. 4A. Namely, the supervisor 3*k* reads out the mode flag from the internal register as by step S1, and checks the mode flag to see whether the player instructs the mechanically sound producing mode, the electronic sound producing mode as by step S2. If the player has instructed the mechanically sound producing mode through the mode shift switch 2*a*, the supervisor 3*k* proceeds to step 3, and instructs the motor driver 2*b* to change the stoppers 2*f* to the free position. Then, the stoppers 2*f* allow the catchers 1*r* to freely move together with the butts 2*m*, and the hammer heads 1*o* can strike the associated sets of strings 1*d* without any interrupt of the stoppers 2*f*.

After the stopper 2*c* thus moved to the free position, the player selectively depresses the black and white keys 1*g*, and the key action mechanisms 1b associated with the depressed keys drive the hammer mechanisms 1c for striking the strings. The behaviors of the keys 1g, the key action mechanisms 1b and the hammer mechanisms 1c are similar to those of the upright piano, and no further description is incorporated hereinbelow for the sake of simplicity.

While the player is performing a music in the mechanically sound producing mode, the supervisor 3k periodically checks the input port assigned to the instruction signal MODE to see whether or not the player changes the mode from the mechanically sound producing mode to the electrically sound producing mode as by step S4.

If the answer to the step S4 is given negative, the supervisor 3k repeats the step S4, and the player continues to perform the music.

However, if the player manipulates the mode shift switch 2a, the answer to the step S4 is given positive, and the supervisor 3k returns to the step S2. If the answer to the step S2 is indicative of the electronically sound producing mode, the supervisor 3k rewrites the mode flag, and the supervisor 3k instructs the driver unit 2b to change the stoppers 2f to the blocking position as by step S5. Then, the leather pads 2h are confronted to the catchers 1r.

While the player is selectively depressing the block and white keys 1g in the electronic sound producing mode, the sound processing unit 3a electronically synthesizes sounds through an electronically sound producing subroutine S6 in cooperation with the key sensors 3b, the pedal sensors 3c, the amplifier 3d and the speaker system 3d. If the player hears the sounds through the headphone 3h, the speaker system 3d keeps silence, and the synthesized sounds do not disturb people sleeping in bed.

In the electronically sound producing mode, when the player depresses one of the keys 1g, the associated key action mechanism 1b, the associated hammer mechanism 1c and the catcher stopper 2c behave as follows. On the way from the rest position to the first intermediate position, the capstan button 1i pushes the whippen 1j, and the whippen 1j rotates in the clockwise direction. The jack pushes the butt 1m, and the butt 1m slowly rotates in the clockwise direction.

Upon reaching the first intermediate position, the toe of the jack 1k is brought into contact with the regulating button 1p, and the catcher 1r is close to the leather pad 2h.

While the player is depressing from the first intermediate position to the second intermediate position, the whippen 1j compresses the spring 1q, and the regulating button 1p and the leather pad 2h keep the relative position between the jack 1k and the butt 1m.

When the key 1g reaches the second intermediate position, the elastic force accumulated by the spring 1q causes the jack 1k to escape from the butt 1m, and the unique key touch is given to the player. However, the catcher 1r rebounds on the leather pad 2h before the hammer head 1o strikes the set of the strings 1d.

When the player releases the key 1g, the key returns from the end position toward the rest position, and the whippen 1j moves the back check felt 1u toward the catcher 1r. The back check felt 1u is brought into contact with the catcher skin 1s, and stops the catcher 1r and the butt 1m at the home position.

Figure 4B:
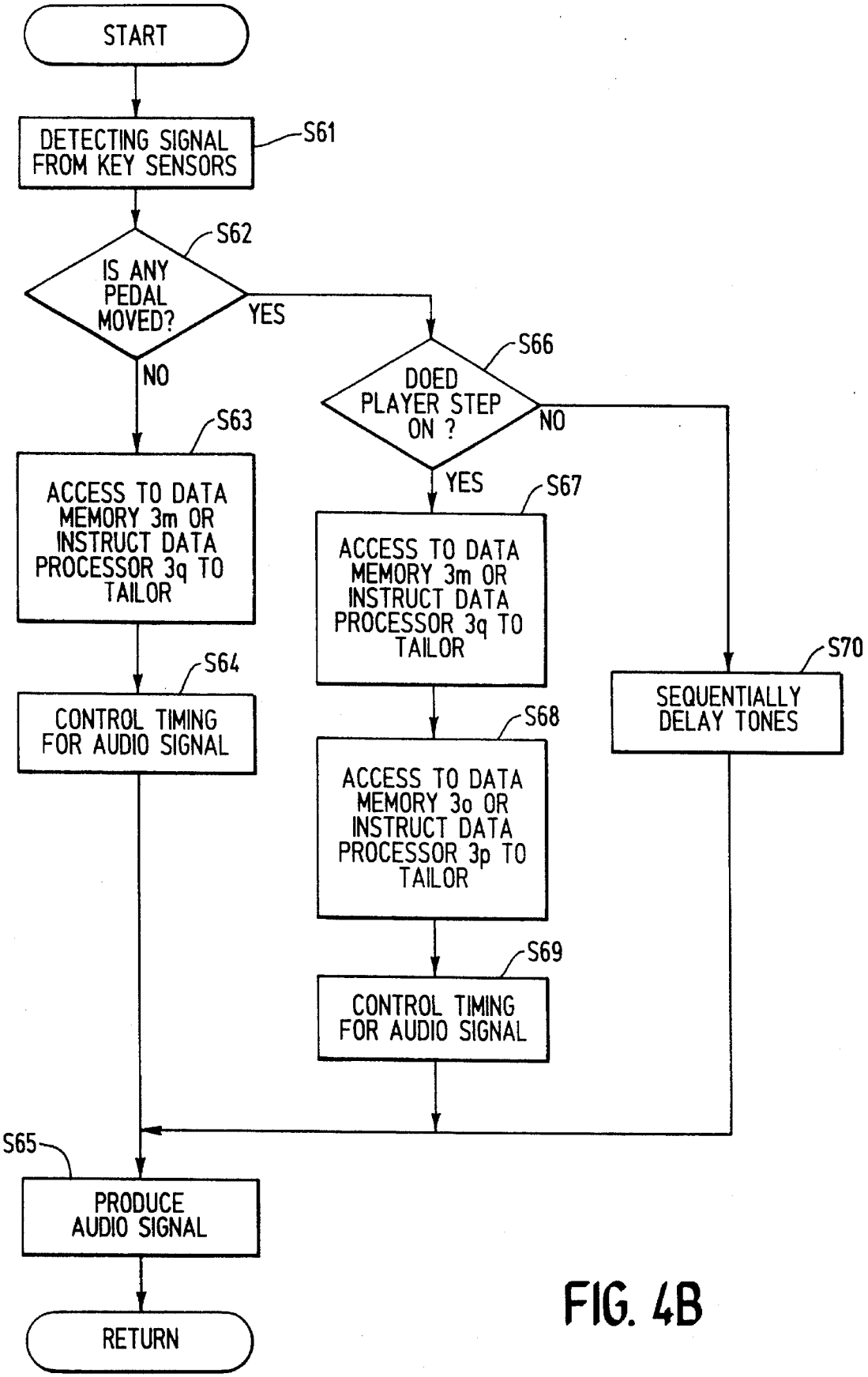

FIG. 4B illustrates the electronic sound producing subroutine. Upon entry of the electronic sound producing subroutine S6, the supervisor 3k monitors the input port assigned to the detecting signals from the key sensors 3b, and receives the detecting signal from the key sensors 3b as by step S61, if any. After the receipt of the detecting signal, the supervisor 3k identifies the depressed key, and determines the key velocity on the basis of the detecting signal.

The supervisor 3b further checks the input port assigned to the detecting signals from the pedal sensors 3c to see whether or not one of the pedals is moved as by step S62. If the answer to the step S62 is given negative, the supervisor 3k accesses one of the groups of pcm data codes associated with the depressed key in the data memory 3m or instructs the data processor 3q to tailor a group of pcm data codes for the depressed key.

The supervisor 3k accesses the internal table thereof, and determines appropriate timing for producing the audio signal as by step S64. The supervisor 3k waits for the appropriate timing, and supplies the group of pcm data codes to the audio signal generator 3u for producing the audio signal as by step S65. Then, the audio signal is amplified by the amplifier 3d, and the speaker system 3e produces a synthesized sound corresponding to the depressed key.

After the step S65, the supervisor 3k returns to the program sequence shown in FIG. 5A, and proceeds to step S7 in FIG. 4A.

However, if one of the pedal such as the damper pedal is moved, the answer to the step S62 is given positive, and the supervisor 3k checks the detecting signal from the pedal sensors 3c to see whether or not the pedal is pushed down as by step S66. If the player steps on the pedal, the answer to the step S66 is given positive, and the supervisor 3k accesses the pcm data codes in the data memory 3m or instruct the data processor 3q to tailor the pcm data codes as by step S67.

The supervisor further accesses the pcm data codes in the data memory 3o or instructs the data processor 3p to tailor the pcm data codes as by step S68 so as to simulate the resonant vibrations on the related strings. The supervisor 3k controls the timing of the pcm data codes for the original vibrations and the timing of the pcm data codes for the resonant vibrations as by step S69, and time delay is introduced between the timing for the original vibrations and the timing for the resonant vibrations. Upon completion of the step S69, the supervisor 3k proceeds to the step S65.

On the other hand, if the pedal is upwardly moved to the rest position, the answer to the step S66 is given negative, and the supervisor 3k instructs the data processor 3q to sequentially decrease the values of the pcm data codes at a selected speed so as to decay the synthesized tone and the resonant tones as by step S70. Then, the supervisor 3k proceeds to the step S65.

Turning back to FIG. 4A, while the player is performing the music in the electronic sound producing mode, the supervisor 3k periodically checks the input port assigned to the instruction signal MODE to see whether or not the mode is changed to the mechanically sound producing mode as by step S7.

If the answer to the step S7 is given negative, the supervisor 3k returns to the step S6, and reiterates the loop consisting of the steps S6 and S7.

However, if the answer to the step S7 is given positive, the supervisor 3k returns to the step S2 again.

Thus, the supervisor 3k sequentially executes the loop consisting of the steps S2 to S7, and the player performs the music in either sound producing mode.

As will be appreciated from the foregoing description, the keyboard instrument according to the present invention is equipped with the catcher stopper 2c switched between the free position and the blocking position, and the player can enjoy a music without disturbing his family and neighborhood.

Moreover, the catcher stopper 2*c* is added to an upright piano for providing the acoustic piano 1 without change of a component member of the upright piano, and upright piano already used can be easily remodeled. The catcher 1*r* is shorter than the hammer shank 1*n*, and the moment exerted on the leather pad 2*h* is small. For this reason, the leather pads 2*h* can serve for long time without change.

Second Embodiment

Figure 5:
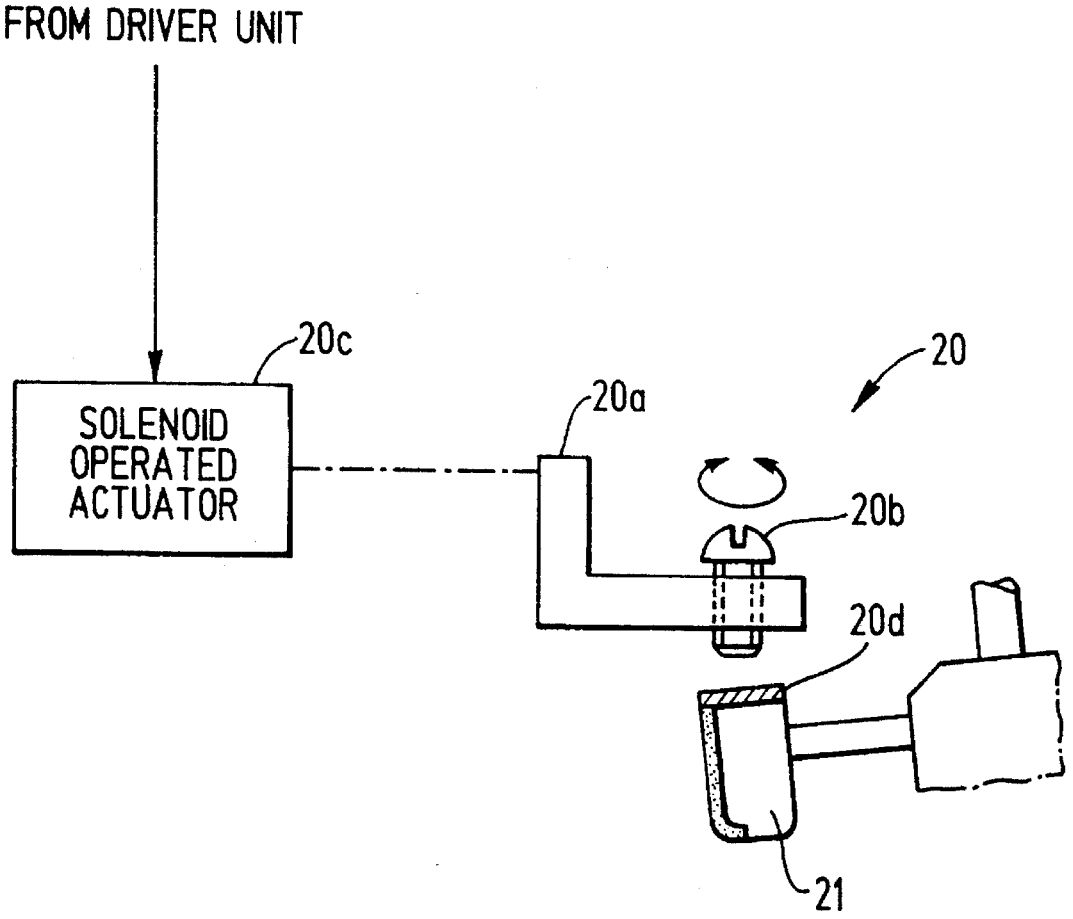
FIG. 5 is a side view showing the structure of a catcher stopper incorporated in another keyboard instrument according to the present invention.

Turning to FIG. 5 of the drawings, another catcher stopper 20 is illustrated, and is incorporated in another keyboard instrument embodying the present invention. The keyboard instrument implementing the second embodiment also largely comprises an acoustic piano, a controlling system and an electronic sound generating system, and selectively enters a mechanical sound producing mode and an electronic sound producing mode as similar to the first embodiment.

The acoustic piano and the electronic sound generating system of the second embodiment are similar to those of the first embodiment, and the controlling system is only different in the structure of a catcher stopper 20 from the controlling system 2 of the first embodiment. For this reason, description is focused on the catcher stopper 20.

The catcher stopper 20 comprises a movable bracket member 20*a* having a plurality of threaded holes, a plurality of screws 20*b* respectively associated with catchers 21 and screwed into the threaded holes, a solenoid-operated actuator 20*c* for shifting the movable bracket between the free position and the blocking position and a plurality of cushion sheets attached to the upper surfaces of the catchers 21.

The solenoid-operated actuator 20*c* is responsive to a driving signal supplied from a driver unit (not shown), and projects and retracts the movable bracket member 20*a* into and from the blocking position. While the movable bracket member 20*a* is in the free position, the catcher 21 and the associated butt freely rotate without interruption of the screws 20*b*.

On the other hand, the screws 20*b* in the blocking position restrict the rotations of the catchers 21, and the key action mechanisms give the unique piano key-touch to a player without acoustic sound.

The screws 20*b* is turnable without any special tool, and allow a tuner to easily regulate the distance from the associated catchers 21.

Third Embodiment

Figure 6:
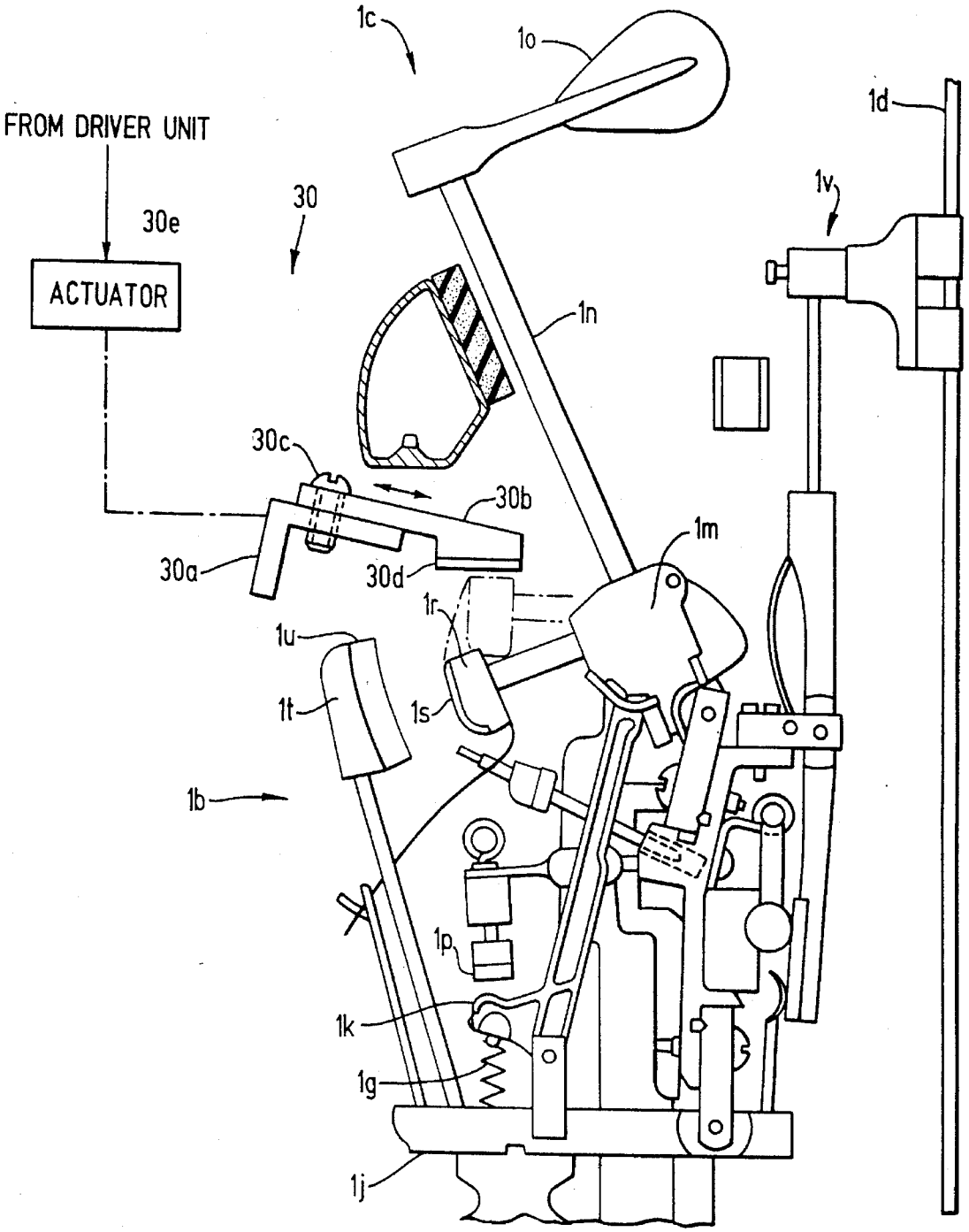
FIG. 6 is a side view showing the structure of a key action mechanism accompanied with a catcher stopper incorporated in yet another keyboard instrument according to the present invention.

Turning to FIG. 6 of the drawings, a catcher stopper 30 embodying the present invention is associated with one of the key action mechanisms 31 incorporated in yet another keyboard instrument according to the present invention. The keyboard instrument implementing the third embodiment also largely comprises an acoustic piano, a controlling system and an electronic sound generating system, and selectively enters a mechanical sound producing mode and an electronic sound producing mode as similar to the first embodiment.

The acoustic piano and the electronic sound generating system of the third embodiment are similar to those of the first embodiment, and the controlling system is only different in the structure of a catcher stopper 30 from the controlling system 2 of the first embodiment. For this reason, components corresponding to those of the first embodiment are labeled with the references used in FIG. 2 without detailed description, and description is focused on the catcher stopper 30.

The catcher stopper 30 comprises a movable bracket member 30*a* shared between all of the key action mechanisms 1*b*, a plurality of projecting members 30*b* fixed to the movable bracket member 30*a* through screws and respectively associated with the key action mechanisms 1*b*, a plurality of cushion members 30*d* respectively attached to the lower surfaces of the projecting members 30*b* and an actuator 30*e* responsive to a driving signal from a driver unit (not shown) for shifting the projecting members 30*b* between the free position and the blocking position.

Figure 7:
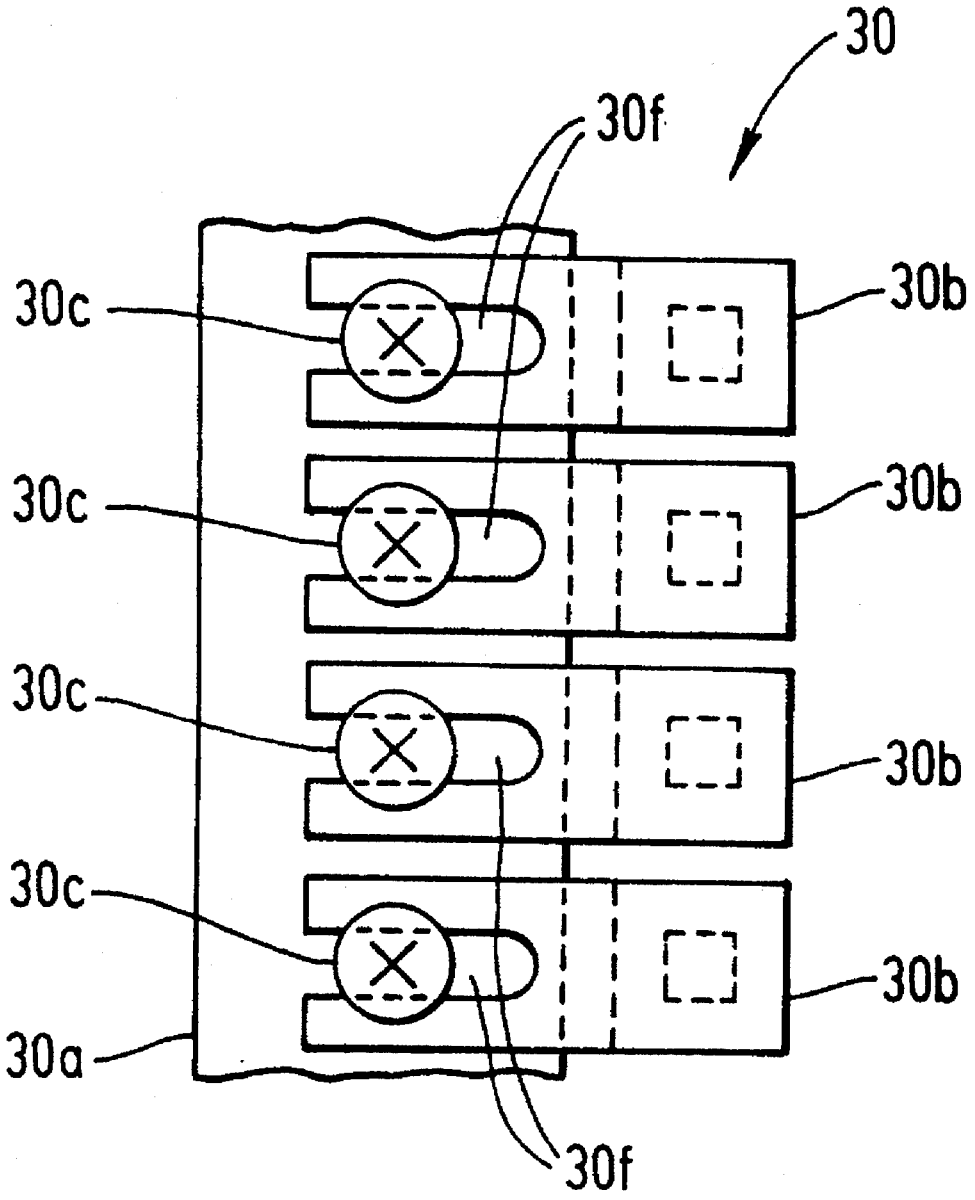
FIG. 7 is a plan view showing stoppers retained by a movable bracket member incorporated in the keyboard instrument shown in FIG. 6.

As will be better seen from FIG. 7, slits 30*f* are respectively formed in boss portions of the projecting members 30*b*, and the screws 30*c* press the boss portions to the upper surface of the movable bracket member 30*a*. The leading end portions of the projecting members 30*b* are longer than the thickness of the catchers (see FIG. 6), and are oblique with respect to the upper surfaces of the catchers 1*r*.

When a tuner regulates the distance between the upper surfaces of the catchers 1*r* and the cushion sheets 30*d*, the screws 30*c* are loosened, and projects or retracts the projecting members 30*b* with respect to the front edge of the movable bracket member 30*a*. If a projecting member 30*b* is projected from the front end, the cushion sheet 30*d* becomes closer to the upper surface of the associated catcher 1*r*. On the other hand, if a projecting member 30*b* is retracted, the cushion sheet 30*d* is further spaced from the upper surface of the catcher 1*r*.

Thus, the tuner can access the screws 30*c* from the front side of the keyboard instrument, and the regulation is easily carried out.

Fourth Embodiment

Figure 8:
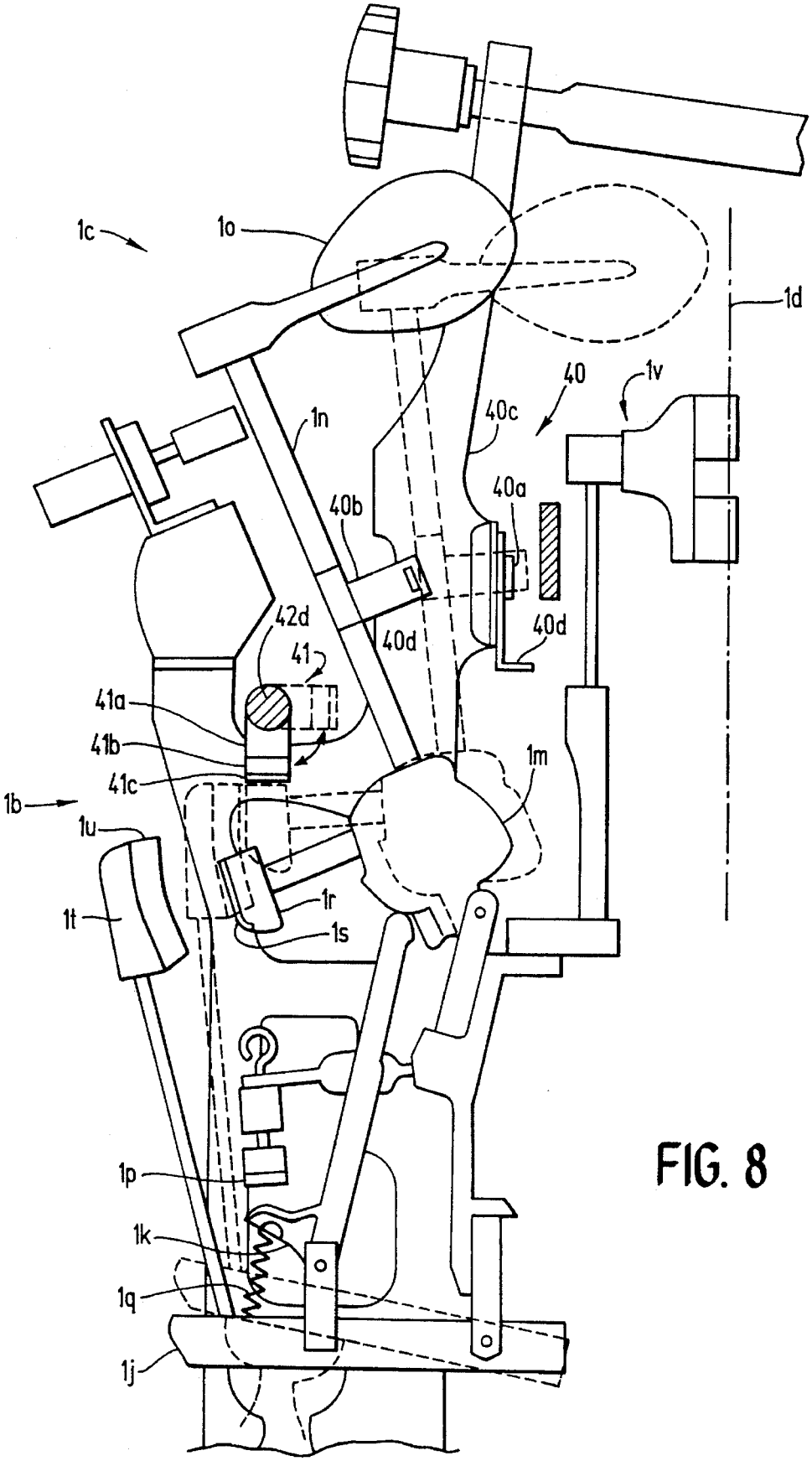
FIG. 8 is a side view showing a catcher stopper associated with a key action mechanism incorporated in still another keyboard instrument according to the present invention.

Turning to FIG. 8 of the drawings, essential parts of still another keyboard instrument embodying the present invention is illustrated. The keyboard instrument implementing the fourth embodiment also largely comprises an acoustic piano, a controlling system and an electronic sound generating system, and selectively enters a mechanical sound producing mode and an electronic sound producing mode as similar to the first embodiment.

The acoustic piano of the third embodiment is analogous to the acoustic piano 1, and the electronic sound generating system is similar to that of the first embodiment except for an array of hammer sensors 40. For this reason, component parts corresponding to those of the first embodiment are labeled with the references used in FIG. 2 without detailed description, and description is focused on the catcher stopper 30.

In the fourth embodiment, the hammer sensors 40 are respectively associated with the hammer mechanisms 1*c*, and detect the respective hammer motions instead of the key sensors 3*b*. Each of the hammer sensors 40 is implemented by the combination of a photo-interrupter 40*a* and a shutter plate 40*b*. Between action brackets 40*c* is provided a rail member 40*d* to which the photo-interrupters 40*a* are fixed in association with the hammer shanks 1*n* of the hammer mechanisms 1*c*. The photo-interrupter 40*a* is the combination of a photo-emitting element and a photo-detecting element, and the shutter plate 40*b* passes across an optical path between the photo-emitting element and the photo-detecting element.

The controlling system is only different in the structure of a catcher stopper 30 from the controlling system 2 of the first embodiment. A slit 40*d* is formed in the shutter plate 40*b*, and the photo-interrupter 40*a* produces an electric signal with two peak voltages while the shutter plate 40*b* is passing across the optical path. The lapse of time between the peaks is proportional to the hammer velocity, and a supervisor incorporated in a sound processing unit estimates the impact of the hammer head 1*o* at the associated strings 1*d*.

The controlling system of the fourth embodiment comprises a plurality of catcher stoppers 41 spaced at intervals and a driving mechanism 42 for the catcher stopper 41. Each of the catcher stoppers 41 is shared between selected catchers 1*r*. The catcher stoppers 41 are shifted between a free position and a blocking position by a player. While the catcher stoppers 41 are in the free position, the catchers 1*r* are movable without any interruption of the catcher stoppers 41. However, if the catcher stoppers 41 enter into the blocking position, the catchers are brought into contact with the associated catcher stoppers 41 before the hammer heads 1*o* strike the associated strings 1*d*.

Figure 9:
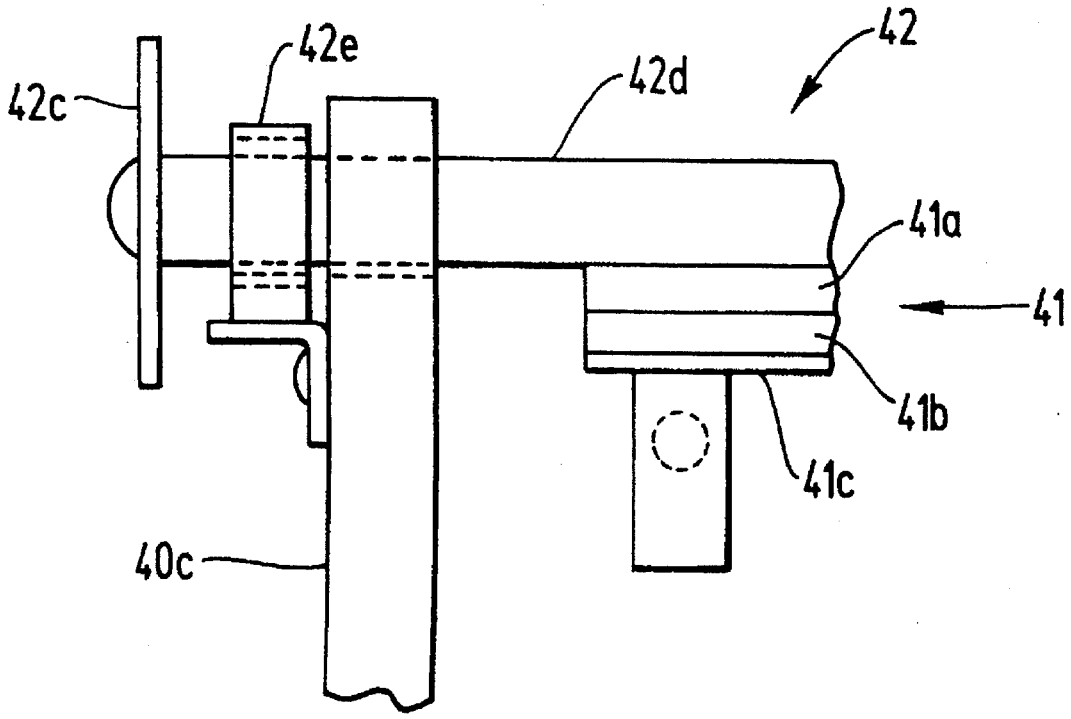
FIG. 9 is a front view showing a part of a driving mechanism of the catcher stopper.
Figure 10:
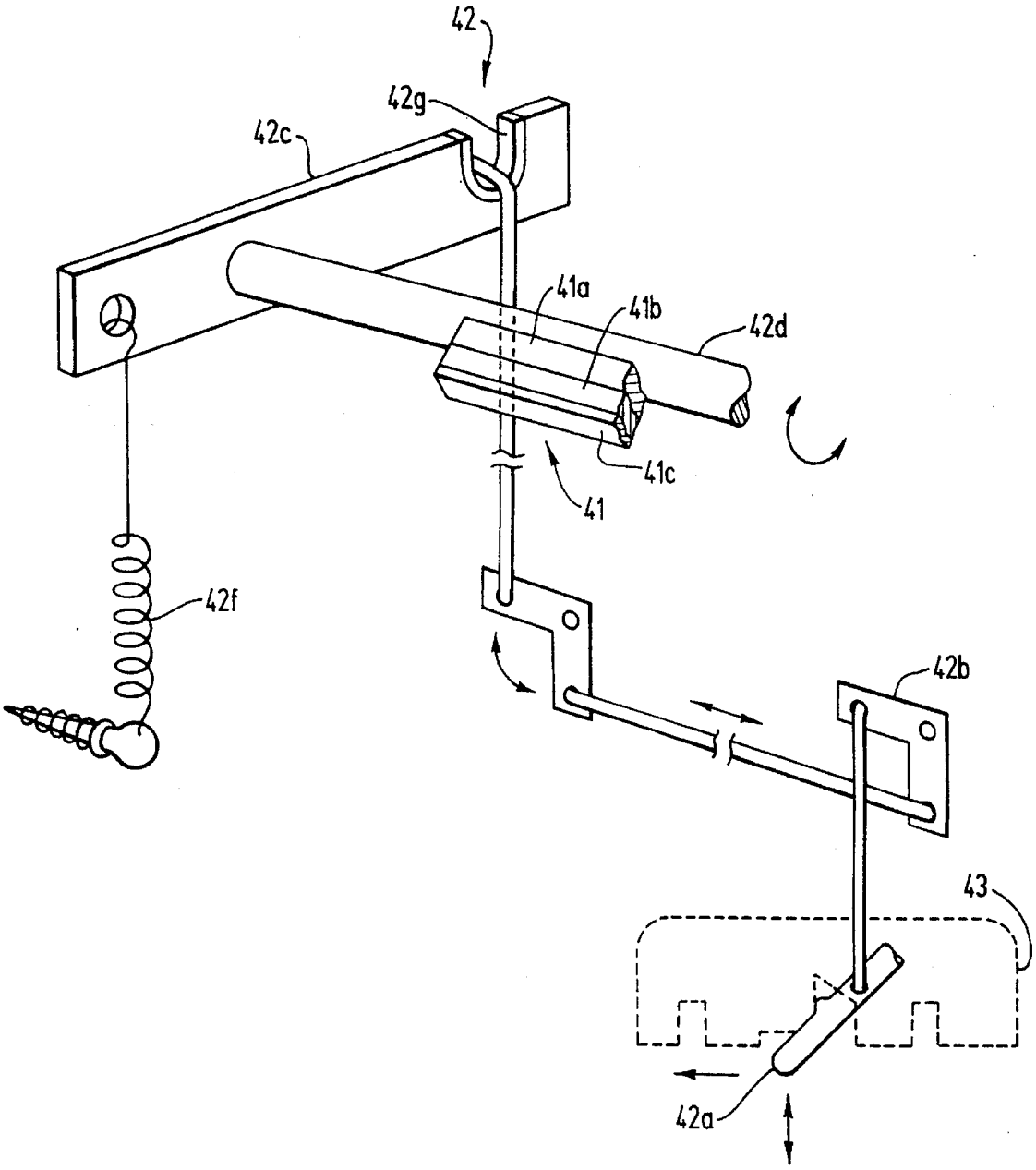
FIG. 10 is a perspective view showing the structure of the driving mechanism.

As will be better seen from FIGS. 9 and 10, the driving mechanism 42 comprises a pedal 42*a* projecting from the lower front board 43, a link mechanism 42*b* connected at one end thereof with the peal 42*a*, an arm member 42*c* connected with the other end of the link mechanism 42*b*, a rod member 42*d* rotatably supported by journal units 42*e* and connected with the arm member 42*c* and a return spring 42*f* connected with the arm member 42*c*. The rod member 42*d* is formed of wood, metal or synthetic resin, and well withstands impacts of the catchers 1*r*. The journal units 42*e* are supported by the action brackets 40*c*, and the return spring is anchored at a stationary board member of the acoustic piano. The arm member 42*c* is partially cut away, and a felt member 42*g* is bonded to the periphery. The link mechanism 42*b* passes on the felt member 42*g*, and is terminated at the arm member 42*c*. The felt member 42*g* allows the link mechanism 42*b* to move without noise.

When the player steps on the pedal 42*a*, the link mechanism 42*b* pulls down the arm member 42*c*, and the rod member 42 is driven for rotation so that the catcher stopper 41 enters into the blocking position. If the player laterally pushes the pedal 42*a*, the lower front board 43 keeps the catcher stopper 41 in the blocking position.

On the other hand, if the player pushes the pedal 42*a* in the opposite direction and releases his foot from the peal 42*a*, the return spring 42*f* pulls down the opposite end of the arm member 42*c*, and the rod member 42*d* is driven for rotation in the opposite direction so as to recover the catcher stopper 41 from the blocking position to the free position.

Each of the catcher stoppers 41 comprises a bracket member 41*a* attached to the rod member 42*d*, a cushion member 41*b* attached to the bracket member 41*a* and a protection sheet 41*c* attached to the cushion member 41*b*. The cushion member 41*b* absorbs the impact of the catcher 1*r*, and is formed of urethane in this instance. The protection sheet 41*c* is formed of excenu, and prolongs the service life of the cushion member 41*b*.

Although particular embodiments of the present invention have been shown and described, it will be obvious to those skilled in the art that various changes and modifications may be made without departing from the spirit and scope of the present invention. For example, a keyboard instrument according to the present invention may further have a silence mode where neither acoustic sound nor synthesized sound is produced.

What is claimed is:

1. A keyboard instrument selectively entering a mechanical sound producing mode and an electronic sound producing mode, comprising:

a) an acoustic piano including a-1) a keyboard having a plurality of keys turnable with respect to a stationary board member, said plurality of keys being selectively depressed in both mechanical and electronic sound producing modes by a player, a-2) a plurality of key action mechanisms respectively coupled with said plurality of keys, and selectively actuated by said plurality of keys when said player depresses, said plurality of key action mechanisms having respective whippens functionally connected with said plurality of keys, respectively, respective catchers respectively projecting from butts and respective back checks respectively projecting from said whippens so as to be brought into contact with said catchers when said player releases the associated keys, a-3) a plurality of hammer mechanisms respectively associated with said plurality of key action mechanisms, and having respective hammer heads and said butts supporting said hammer heads, respectively, said plurality of key action mechanisms being driven for rotation by said plurality of key action mechanisms when said player selectively depresses said plurality of keys, and a-4) a plurality of strings associated with said plurality of hammer mechanisms, and struck by said hammers in said mechanical sound producing mode when the player selectively depresses said plurality of keys;

b) an electronic sound producing means monitoring said plurality of keys to see what keys are depressed by said player in said electronic sound producing mode, and operative to electronically produce sounds corresponding to the keys depressed by said player; and c) a controlling means having a plurality of movable stoppers associated with said catchers, and a driver unit responsive to an instruction of said player for driving said plurality of movable stoppers between a free position in said mechanically sound producing mode and a blocking position in said electronically sound producing mode, said catchers being freely moved together with the associated butts without interruptions of said plurality of movable stoppers while said movable stoppers are staying in said free position, said catchers being brought into contact with said movable stoppers in said blocking position before the associated hammer heads strike said plurality of strings.

2. The keyboard instrument as set forth in claim 1, in which said plurality of movable stoppers are respectively associated with said catchers, and said driver unit comprises a bracket member shared between said plurality of movable stoppers, an actuator connected with said bracket member for projecting and retracting said bracket member and a driver circuit for energizing said actuator, said plurality of movable stoppers entering into said blocking position when said actuator projects said bracket member, said plurality of movable stoppers entering into said free position when said actuator retracts said bracket member.

3. The keyboard instrument as set forth in claim 2, in which each of said plurality of movable stoppers comprises a bolt member having a threaded portion screwed into said bracket member and a head portion, and a cushion means attached to a lower surface of said head portion and faced to the associated catcher in said blocking position.

4. The keyboard instrument as set forth in claim 3, in which a hole is formed in said head portion so that a tuner regulates a distance between a lower surface of said cushion means and said associated catcher by rotating said head portion with a tool inserted into said hole.

5. The keyboard instrument as set forth in claim 2, in which each of said plurality of movable stoppers comprises a bolt member having a threaded portion screwed into said bracket member and a head portion engageable with a tool, and a cushion means attached to an upper surface of the associated catcher and faced to a leading end of said threaded portion in said blocking position.

6. The keyboard instrument as set forth in claim 2, in which each of said movable stoppers comprises a projecting member having a boss portion with an elongated slit and a leading end portion, a bolt screwed through said elongated slot into said bracket member for pressing said boss portion onto said bracket member and a cushion means attached to a lower surface of said leading end portion and faced to the associated catcher in said blocking position.

7. The keyboard instrument as set forth in claim 1, in which said driver unit comprises a pedal member engageable with a board member of said acoustic piano for maintaining depressed state, a link mechanism connected with said pedal member, a rod member journaled at stationary portions of said acoustic piano, a converting means operative to convert a motion of said link mechanism into a rotation of said rod member and a return spring for allowing said pedal member to return to a rest position when said pedal member is released from said board member, and said plurality of movable stoppers are attached to an outer surface of said rod member at spacings, said plurality of movable stoppers entering said blocking position when said pedal member is depressed, said plurality of movable stoppers entering said free position when said pedal member is released.

8. The keyboard instrument as set forth in claim 7, in which each of said plurality of movable stoppers is shared between selected catchers.

9. The keyboard instrument as set forth in claim 7, in which each of said plurality of movable stoppers comprises a bracket member attached to said outer surface of said rod member, a cushion member attached to said bracket member for absorbing an impact of the catcher and a protecting sheet attached to said cushion member for prolonging a service time of said cushion member.

10. A keyboard instrument comprising:

a) an acoustic piano including a-1) a keyboard having a plurality of keys turnable with respect to a stationary board member, said plurality of keys being selectively depressed in both mechanical and electronic sound producing modes by a player, a-2) a plurality of key action mechanisms respectively coupled with said plurality of keys, and selectively actuated by said plurality of keys when said player depresses, said plurality of key action mechanisms having respective whippens functionally connected with said plurality of keys, respectively, respective catchers respectively projecting from butts and respective back checks respectively projecting from said whippens so as to be brought into contact with said catchers when said player releases the associated keys, a-3) a plurality of hammer mechanisms respectively associated with said plurality of key action mechanisms, and having respective hammer heads and said butts supporting said hammer heads, respectively, said plurality of key action mechanisms being driven for rotation by said plurality of key action mechanisms when said player selectively depresses said plurality of keys, and a-4) a plurality of strings associated with said plurality of hammer mechanisms, and struck by said hammers in said mechanical sound producing mode when the player selectively depresses said plurality of keys; and b) a silence means having a movable stopper means associated with said catchers, and a driver unit responsive to an instruction of said player for driving said movable stopper means between a free position and a blocking position, said catchers being freely moved together with the associated butts without interruptions of said plurality of movable stoppers while said movable stopper means is staying in said free position, said catchers being brought into contact with said movable stopper means in said blocking position before the associated hammer heads strike said plurality of strings.

* * * * *